US011554305B2

(12) United States Patent
Allen

(10) Patent No.: US 11,554,305 B2
(45) Date of Patent: Jan. 17, 2023

(54) VOLLEYBALL HITTING TRAINING DEVICE

(71) Applicant: Greg J. Allen, Tiffin, IA (US)

(72) Inventor: Greg J. Allen, Tiffin, IA (US)

( * ) Notice: Subject to any disclaimer, the term of this patent is extended or adjusted under 35 U.S.C. 154(b) by 0 days.

(21) Appl. No.: 17/248,697

(22) Filed: Feb. 3, 2021

(65) Prior Publication Data

US 2021/0236902 A1 Aug. 5, 2021

Related U.S. Application Data

(60) Provisional application No. 62/969,442, filed on Feb. 3, 2020.

(51) Int. Cl.
*A63B 69/00* (2006.01)

(52) U.S. Cl.
CPC ..... *A63B 69/0095* (2013.01); *A63B 69/0091* (2013.01)

(58) Field of Classification Search
CPC ..... A63B 69/00; A63B 69/0095
See application file for complete search history.

(56) References Cited

U.S. PATENT DOCUMENTS 4,706,964 A * 11/1987 Genovese ..... A63B 69/0079 473/430
4,865,319 A * 9/1989 Drazinakis ..... A63B 69/0079 473/418
5,593,154 A * 1/1997 Allen ..... A63B 69/0079 473/429
5,746,667 A * 5/1998 Fraser ..... A63B 57/10 473/145
9,403,075 B1 * 8/2016 Morgan ..... A63B 69/002
2006/0035730 A1 * 2/2006 Nguyen ..... A63B 69/0073 473/417
2011/0165969 A1 7/2011 Gu
2014/0213392 A1 7/2014 Buono et al.

FOREIGN PATENT DOCUMENTS

KR 200441378 Y1 8/2008

* cited by examiner

*Primary Examiner* — Eugene L Kim
*Assistant Examiner* — Christopher Glenn
(74) *Attorney, Agent, or Firm* — McKee, Voorhees & Sease, PLC

(57) ABSTRACT

A volleyball training apparatus has a laterally extending arm supported on a riser. A resilient member such as a spring is operably connected within the arm. The resilient member is connected to a flexible connector, such as a cable, that is connected to a volleyball. A series of spacers retains the volleyball away from the rigid arm. The height of the arm may be adjustable to locate the volleyball at a desired height. After a user strikes the volleyball, the volleyball is displaced from its original static position, but quickly is snapped back into the static position by the resilient member pulling the volleyball toward the arm against the spacers.

20 Claims, 6 Drawing Sheets

VOLLEYBALL HITTING TRAINING DEVICE

CROSS REFERENCE TO RELATED APPLICATION

This application claims priority pursuant to 35 USC § 119(e)(1) to U.S. Provisional Patent Application No. 62/969,442, filed Feb. 3, 2020.

FIELD OF THE INVENTION

The present invention relates generally to athletic training equipment and more specifically to a device to aid in training players to hit or spike a volleyball.

BACKGROUND OF THE INVENTION

There are a few classes of common commercially available volleyball spike trainers. The first group holds the volleyball stationary with friction, and then releases it when hit; which requires chasing down the loose ball and reloading the device. Another class tethers a ball with a loose cord attached to either a support, a ceiling, or to the user. These devices eliminate the need to chase down loose balls but suffer from the disadvantage of either not holding the ball in a consistent location, or not damping the movement quickly. A third class attaches the ball between two bungy cords or elastic bands. This arrangement does overcome the need to chase the ball, and depending on the stiffness of the elastic cord, may rather quickly damp the motion to return the ball to a stationary position. However, it is disadvantageous to use two elastic elements instead of one because the ball reacts differently when struck and because of the inefficiency of using (and supporting) two elastic elements instead of one. These two elastic element devices also run the risk of tangling with a user's arm or wrist which can be uncomfortable at best and risks injury at worst.

It is also known to attach a volleyball to a single elevated arm with a spring. However, these suffer from the disadvantage of the ball not quickly returning to its starting position after being struck such that it can be quickly reused, especially in a line drill.

Accordingly, there is a need for an improved volleyball training apparatus that overcomes or diminishes the disadvantages of the prior art.

SUMMARY OF THE INVENTION

Therefore, it is a principal object, feature, and/or advantage of the disclosed features to overcome the deficiencies in the art.

It is another object, feature, or advantage of the disclosed features to provide a volleyball training device that eliminates the need to chase down a ball after it is struck.

It is another object, feature, or advantage of the disclosed features to provide a volleyball spike training aid that holds the ball in a consistent location and quickly damps the movement of the ball after it is struck.

It is another object, feature, or advantage of the disclosed features to provide a volleyball training aid that is safe and protects the users hand, wrist, and arm, especially on off-center hits.

These and/or other objects, features, and advantages of the disclosure will be apparent to those skilled in the art. The present invention is not to be limited to or by these objects, features and advantages. No single embodiment needs to provide each and every object, feature, or advantage.

According to one embodiment, the invention relates to a volleyball training apparatus comprising that has a rigid hollow arm with a first end adapted for attachment to a riser and an open second end opposite from the first end. A resilient member has a first end and a second end and extends at least partially through the hollow arm. The resilient member is operably secured to the arm at the first end of the resilient member. An end cap covers the open second end of the hollow arm. The end cap includes a central opening. A flexible connector has a first end attached to the second end of the resilient member. The flexible connector extends through the central opening in the end cap and a second end of the flexible connector is operably connected to a volleyball. The volleyball training apparatus may also include at least one spacer surrounding the flexible connector and located between the volleyball and the end cap. The volleyball training apparatus may also have a cup between the at least one spacer and the volleyball, the cup having an open end, whereby the volleyball is urged against the open end of the cup by the resilient member. The cup may be surrounded by a padded layer. A tension level in the resilient member may be adjustable.

According to one embodiment, a volleyball training apparatus has a rigid hollow arm that has a proximal end adapted for attachment to a riser and an open distal end spaced apart from the proximal end. A resilient member that has a first end and a second end extends at least partially through the hollow arm and is operably connected to the arm at the first end of the resilient member. An end cap covers the open distal end of the hollow arm/the end cap has a central opening. A flexible connector has a first end attached to the second end of the resilient member and extends through the central opening in the end cap whereby a second end of the flexible connector is operably connected to a volleyball. At least one spacer may surround the flexible connector and be located between the volleyball and the end cap. Alternatively, at least three spacers may surround the flexible connector and be located between the volleyball and the end cap. A cup may be provided between the at least one spacer and the volleyball, the cup having an open end, whereby the volleyball is urged against the open end of the cup by the resilient member. The cup may be surrounded by a padded layer. A tension level in the resilient member may be adjustable. A chain may operably connect the first end of the resilient member to the arm. The proximal end of the arm may include a slot sized and shaped such that links of the chain will pass through the slot in a first orientation but will not pass through the slot in a second orientation. The chain may extend through the slot; whereby adjustment of the tension level is accomplished by pulling the chain through the slot until a desired tension is achieved and securing the chain by twisting a chain link adjacent to the slot to the second orientation. The volleyball training apparatus may include a riser structure that has an upright riser and a base; wherein the upright riser matingly receives the proximal end of the rigid hollow arm; and wherein the base is adapted to rest on a flat surface. The riser may be adjustable to adjust a height of the arm above the base. The base may include a first end proximate to a connection between the upright riser and the base and a second end opposite from the first end of the base. The riser structure may also include wheels proximate to the first end of the base for rolling transport of the apparatus on the flat surface. The base may be adapted to support at least one weight in a first position proximate to the second end of the base to retard unwanted movement of the apparatus during use. The base may be further adapted to support the at least one weight in second position proximate to the first end of the base to facilitate tilting of the apparatus at the wheels and rolling transport of the tilted apparatus on the wheels across the flat surface. The at least one weight may comprise a hollow container adapted to be filled with a heavy substance. The heavy substance may be water or a flowable solid material.

DETAILED DESCRIPTION OF THE EMBODIMENTS

Figure 1:
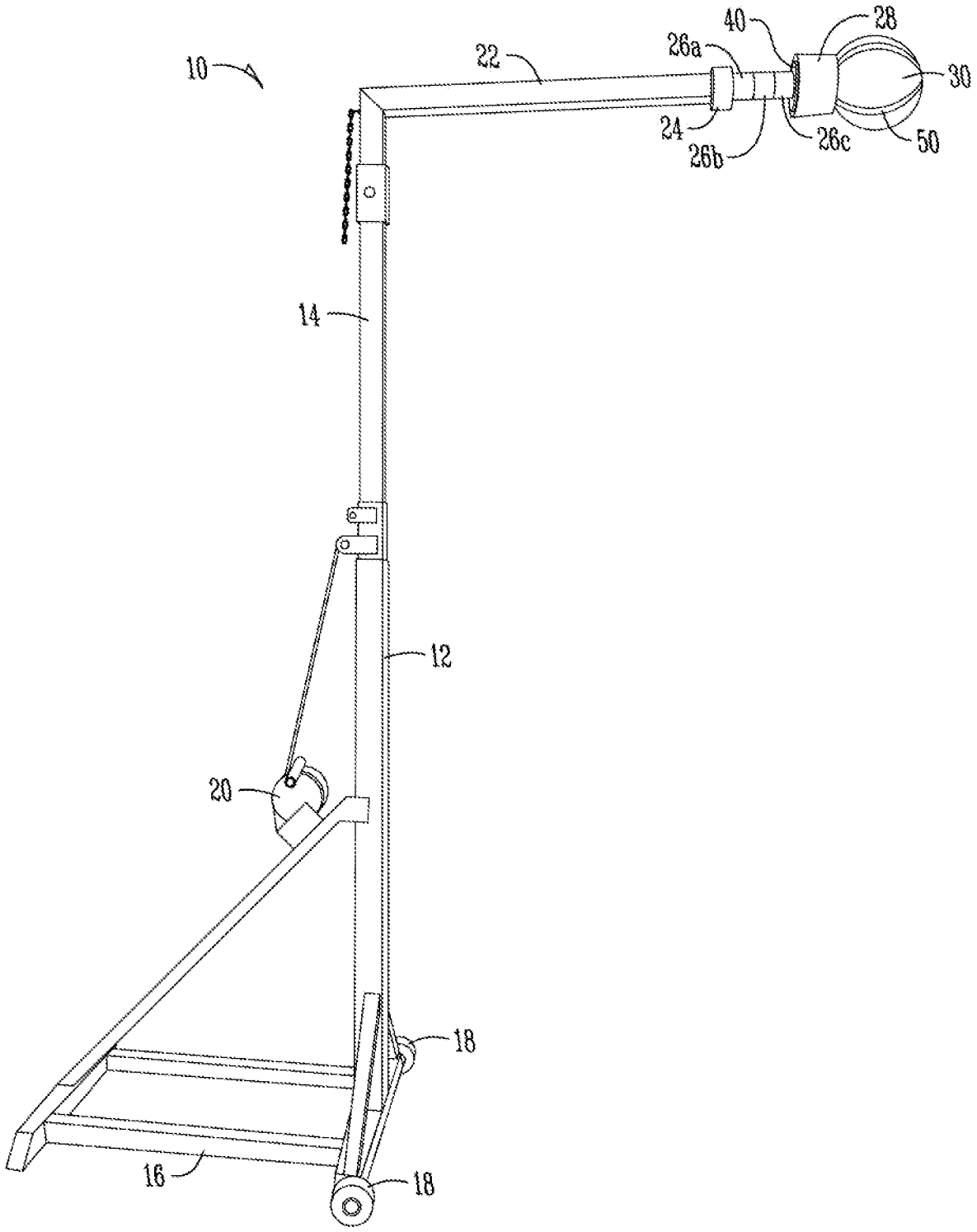
FIG. 1 is a perspective elevation view of a volleyball training device according to one embodiment of the present invention.

FIG. 1 shows a volleyball training apparatus 10 according to one embodiment of the present invention. The apparatus 10 includes an adjustable riser structure 12. The riser structure may include a vertical upright riser 14 and a base 16. The base 16 may include wheels or rollers 18 at a first end to make it easier to move the apparatus 10 to a desired location. A second end of the base opposite from the rollers 18 may include pads or friction material (not shown) to prevent scuffing of the floor and to resist sliding of the apparatus during use. The riser structure 12 preferably includes an adjustment mechanism 20 to facilitate the raising and lowering of the vertical riser 14. A lateral arm 22 extends generally horizontally from the vertical riser 14. The lateral arm 22 may be formed integrally with vertical riser 14, or may be a separate piece that mounts on to the vertical riser 14. At the distal end of the lateral arm 22 is an end cap 24, spacers 26*a*, 26*b*, and 26*c*, a padded collar 28, and volleyball 30. A chain 32 is used as a tension adjustment mechanism in a manner that is described below.

Figure 2A:
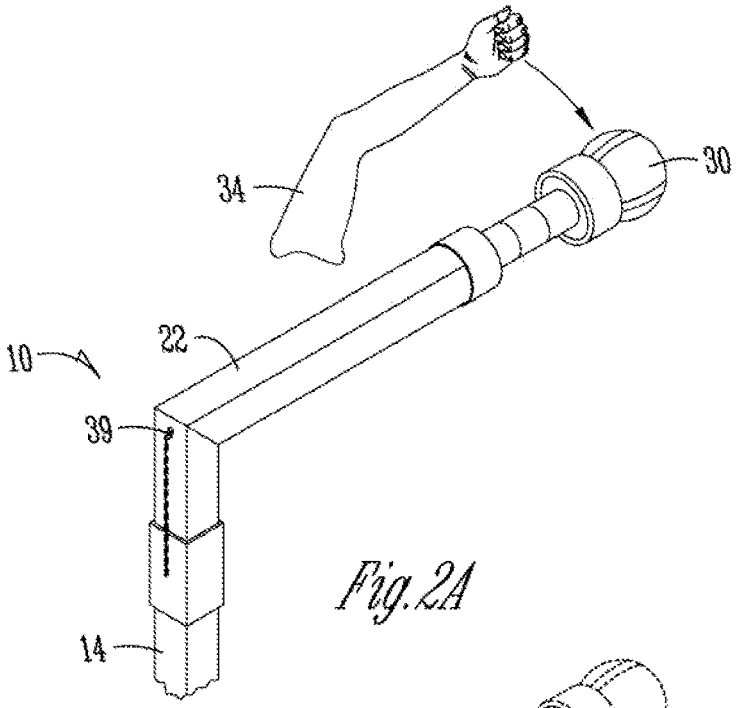
FIG. 2A is a partial perspective view of a lateral arm and ball of the device of FIG. 1, with the ball in a static resting position about to be struck by a user's hand.
Figure 2B:
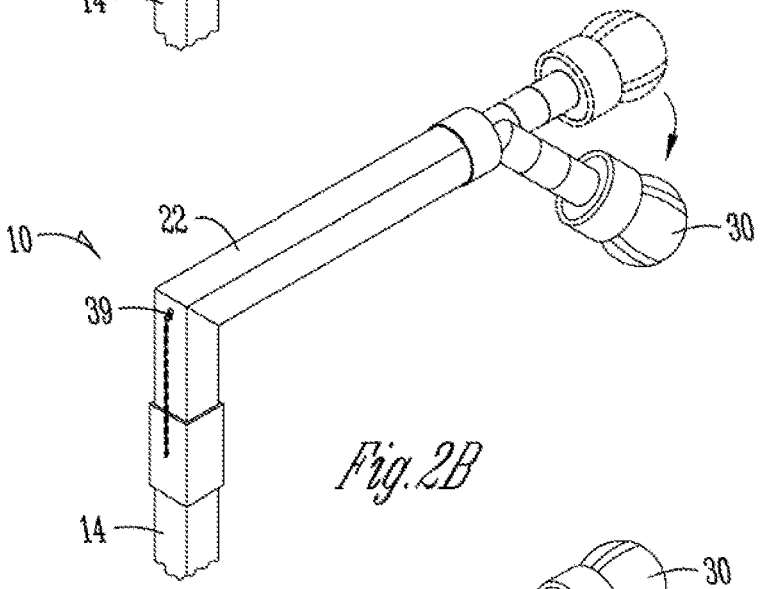
FIG. 2B shows the lateral arm and ball of FIG. 2A immediately after the ball has been struck, with the ball displaced from the static resting position.
Figure 2C:
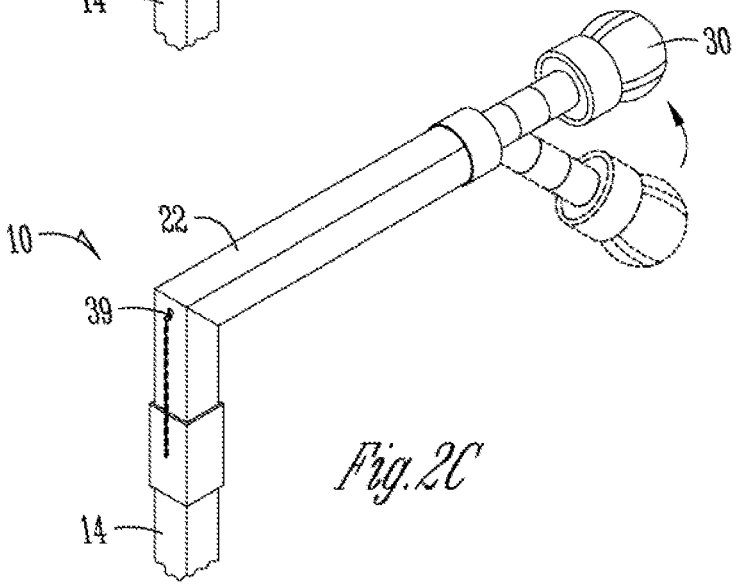
FIG. 2C shows the lateral arm and ball of FIG. 2B after the ball has snapped back to its resting static position ready for use by a second user.

Use of the training apparatus 10 is illustrated in FIGS. 2A, 2B, and 2C. The vertical riser 14 is adjusted to position the volleyball 30 to a desired height. A user (volleyball player) approaches the volleyball 30, leaps into the air, and strikes the volleyball 30 with his or her hand 34 as shown in FIG. 2A. Providing a consistent location of the volleyball 30 helps a user 34 focus on technique and provides feedback to the user and the user's coach about how changes in technique affect the height of the user's jump and quality of contact with the volleyball 30. The apparatus 10 may be located near a net (not shown) to simulate game conditions and to provide additional feedback and training related to positions for the user's run-up, jump and landing. Ideally the user should be able to raise the volleyball 30 to higher heights as the user's technique improves through use of the apparatus 10.

As seen in FIG. 2B, after the volleyball 30 is struck by the user 34, the volleyball 30 is displaced from the static position of FIG. 2A. The provides feedback to the user 34, permits a realistic simulation of the feel of hitting a volleyball 30 during play, and allows enough give to avoid uncomfortable or even potentially injurious contact that might occur if the volleyball 30 was rigidly mounted. As seen in FIG. 2C, the volleyball 30 rather quickly snaps back into place in the static position so that it is ready to be struck again, either by the same user or another user—for example in a line drill.

Figure 3:
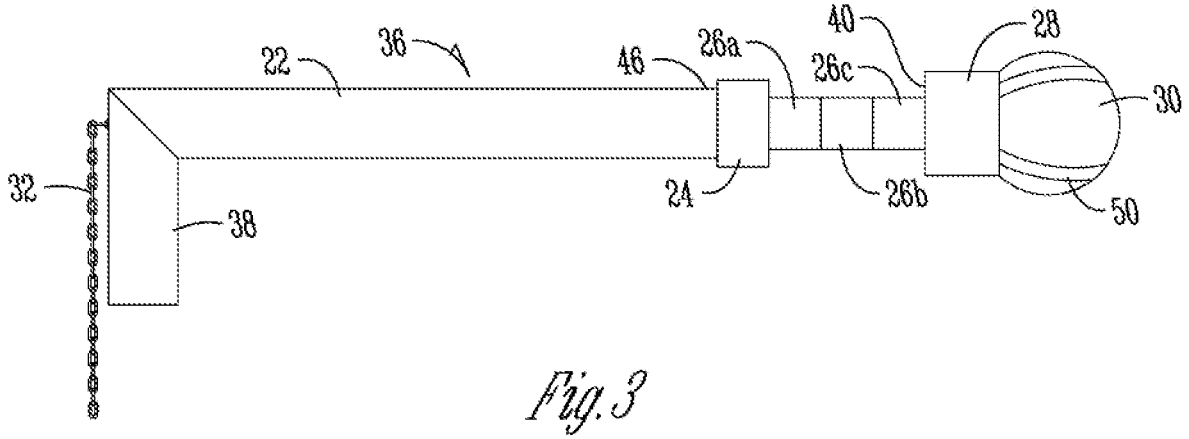
FIG. 3 is a side elevation view of a device adapted to be attached to an existing riser structure, the device includes a lateral arm and ball similar to the device of FIG. 1, with the ball in the static resting position.
Figure 4:
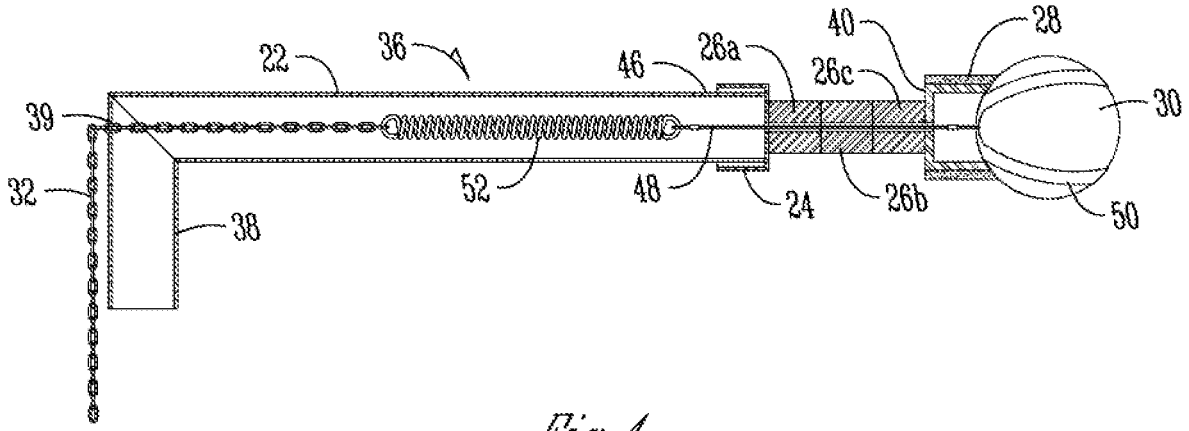
FIG. 4 is a cross-section view of the device of FIG. 3.

FIG. 3 shows a training apparatus 36 that is adapted to be added to an existing riser structure. For example, the apparatus 36 could be used with an existing riser with square tubes, such as commonly used to support basketball backboards in portable or driveway installations. The apparatus 36 includes a vertical stub 38 extending below the proximal end of the lateral arm 22 that is adapted to mate with an existing riser. Otherwise, the structure is essentially the same as shown FIGS. 1 and 2 and in fact could be used with the riser structure 12 of FIGS. 1 and 2, except that the riser of FIG. 2 uses circular rather than square tubes. It is contemplated that the lateral arm 22 and especially the vertical stub 38 could be shaped as needed to cooperate with any common riser structure. Also more readily seen in FIG. 4 end cup 40 is covered by a padded collar 28. As seen in FIG. 4, the end cup 40 has an open end facing the volleyball 30 to allow the volleyball 30 to seat securely against the walls of the end cup 40.

Figure 5:
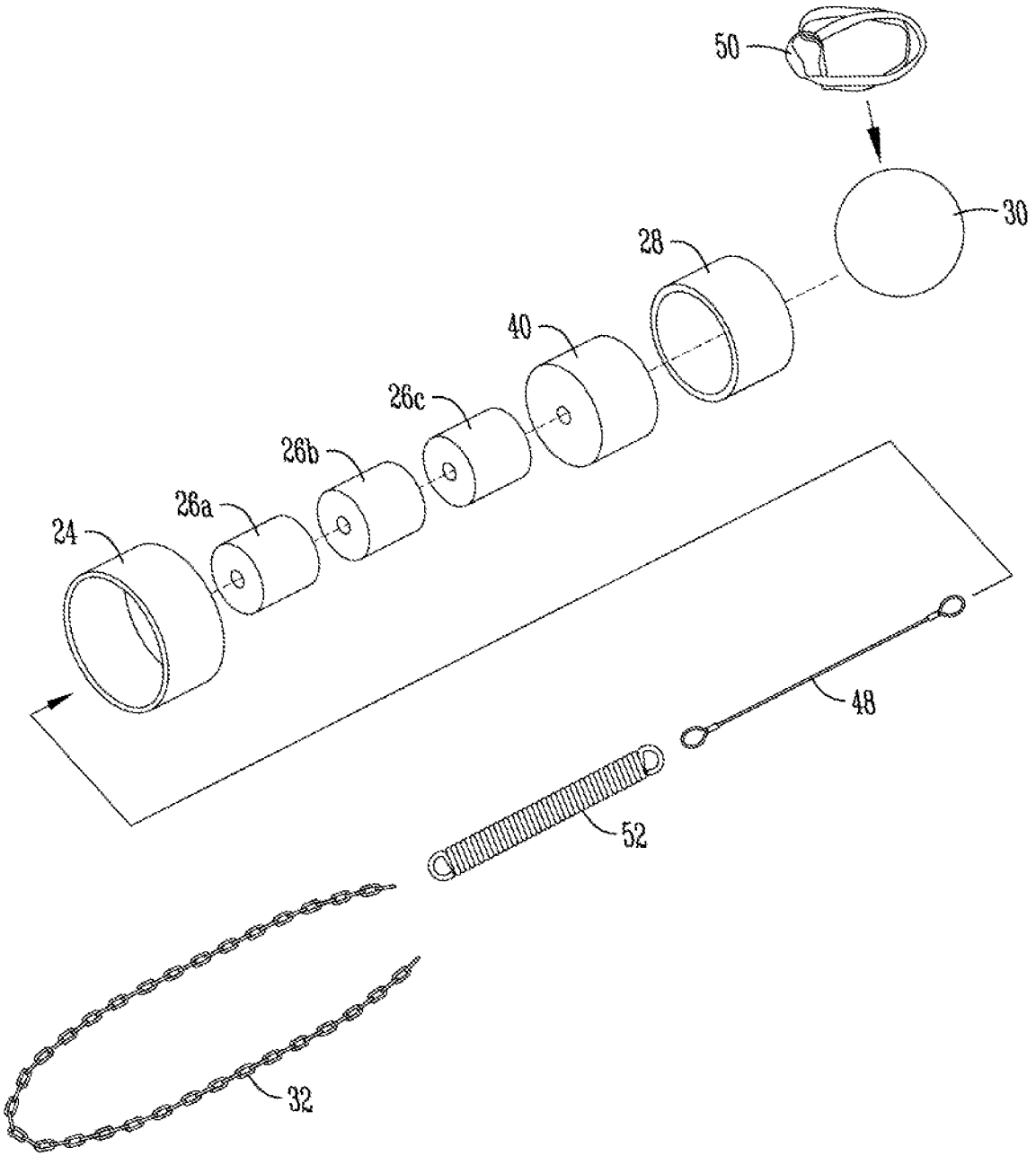
FIG. 5 is an exploded view of the connecting elements and spacers of one embodiment of a volleyball training device according to the present invention.

FIG. 5 shows the internal components of apparatus 36 in an exploded configuration for better understanding. A cap 24 abuts and covers an open end 46 of the lateral arm 22. The cap 24, spacers 26*a, b*, and *c* and end cup 40 all include central openings to receive a flexible connector 48 that passes through each of the cap 24, spacers 26*a, b*, and *c* and cup 40 and connects the volleyball holding straps 50 to a resilient member 52. The volleyball holding straps 50 may be two nylon straps provided with metal rings or eyelets (not shown) to provide a connection location for the flexible connector 48. Other known mechanisms for attaching a volleyball to a flexible cord may be used. In the embodiment shown, the flexible connector 48 is made from ⅛-inch braided wire. Other materials and structures may be used as the flexible connector 48. A helical tension spring serves as the resilient member 52 in the shown embodiment. Other resilient devices, such as elastic cords or other types of springs may serve as the resilient member 52.

FIG. 4 is a cross-section view of a training apparatus 36 of FIG. 3. A generally hollow lateral arm 22 is attached to a vertical stub 38 that mates with an existing riser structure. Alternatively, the lateral arm 22 and vertical stub 38 may be formed from a single hollow tube bent to the desired shape. The vertical stub 38 may include a passage to permit a pin or other retaining member (not shown), to secure the apparatus 36 to the riser. At a proximal end of the lateral arm 22 a spring adjustment mechanism is provided. In the embodiment shown, the spring adjustment mechanism comprises a chain 32 attaches to the resilient member 52 and can be pulled through an opening 39 in the vertical stub 38 to adjust the tension in the resilient member 52. A hook or other protrusion (not shown) may be provided on the exterior of the vertical stub 38 to capture a link in the chain 32 and retain the chain 32 in place. Alternatively, as shown, the opening 39 in the vertical stub 38 may be a slot that only permits passage of the links when oriented in first direction, and the chain 32 may be held in place by twisting the chain 32 to the opposite orientation outside the slot 39. In any event, the chain 32 or other spring adjustment mechanism should be pulled tight to pull the volleyball 30 via the cable 48 and the spring 52 tightly against the cylinder 44, which in turn presses against end cup 40 and the spacers 26*a-c*, which are pressed against the end cap 24. FIG. 7 shows the apparatus 36 of FIG. 6 with the spring adjustment mechanism 58 pulled tight such that the volleyball 30 is in position for use.

Returning to FIGS. 2A-C, with the structure illustrated in FIGS. 3-5 in mind, it can be seen that once the volleyball 30 is struck by the user 34, the volleyball 30 through its retraining straps 50 pulls against the flexible cable 52 and thereby stretches the resilient spring 52. This permits the volleyball to be temporarily dislodged from the static position of FIG. 2A as shown in FIG. 2B. However, as shown in FIG. 2C, the spring 52 pulling against the cable 48 quickly returns the volleyball 30 to the static position with the spacers 40, 26*a-c*, and 24 in contact with each other and the movement of the volleyball 30 quickly arrested. The use of multiple spacers 26*a-c* instead of a single spacer is preferred because it permits greater flexibility in system and creates less stress as compared to a single larger spacer.

Figure 6:
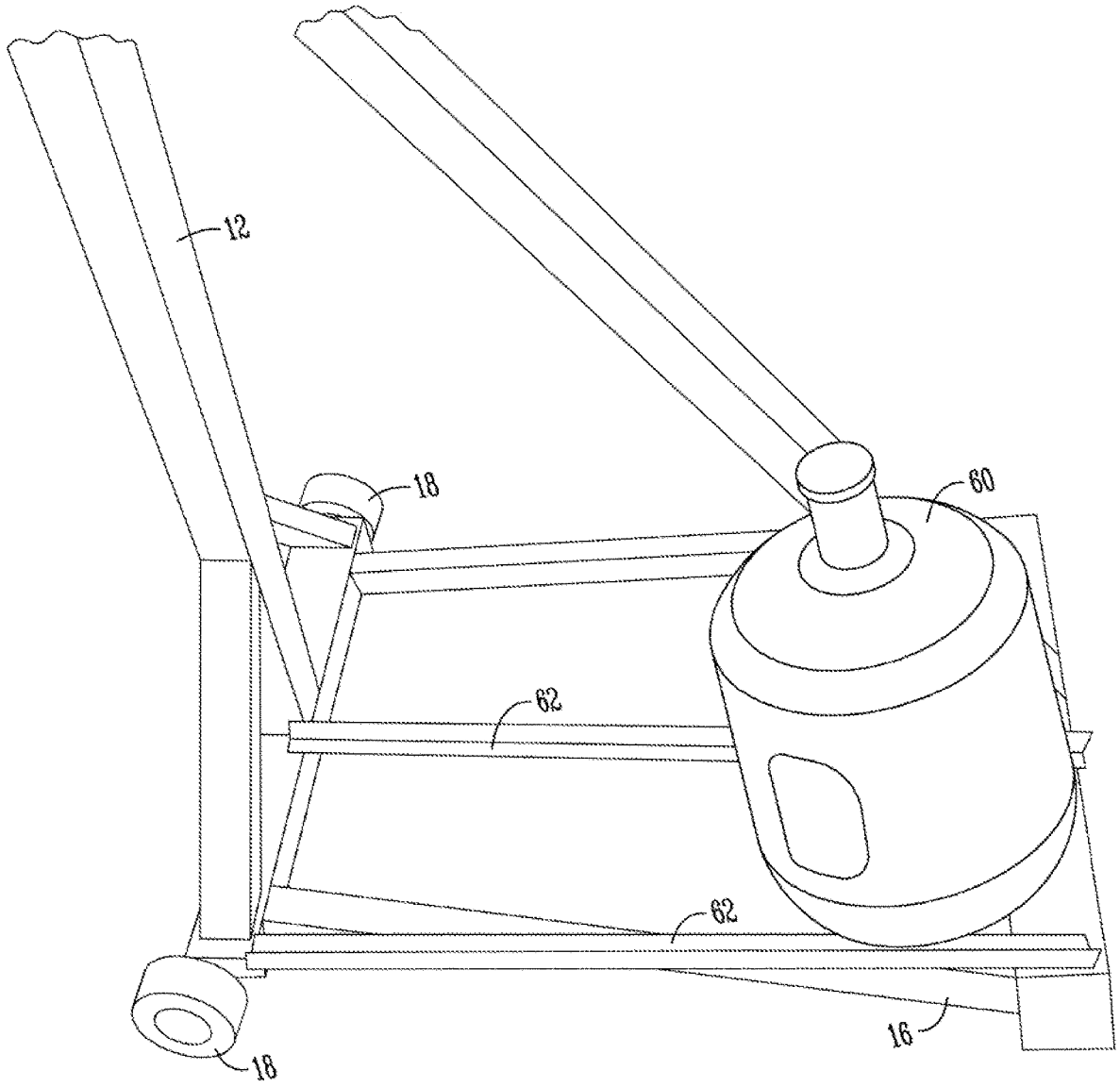
FIG. 6 is a partial view of a lower portion of a volleyball training device according to the present invention with a water jug resting on the base of the device to discourage unwanted wandering of the device during use.
Figure 7:
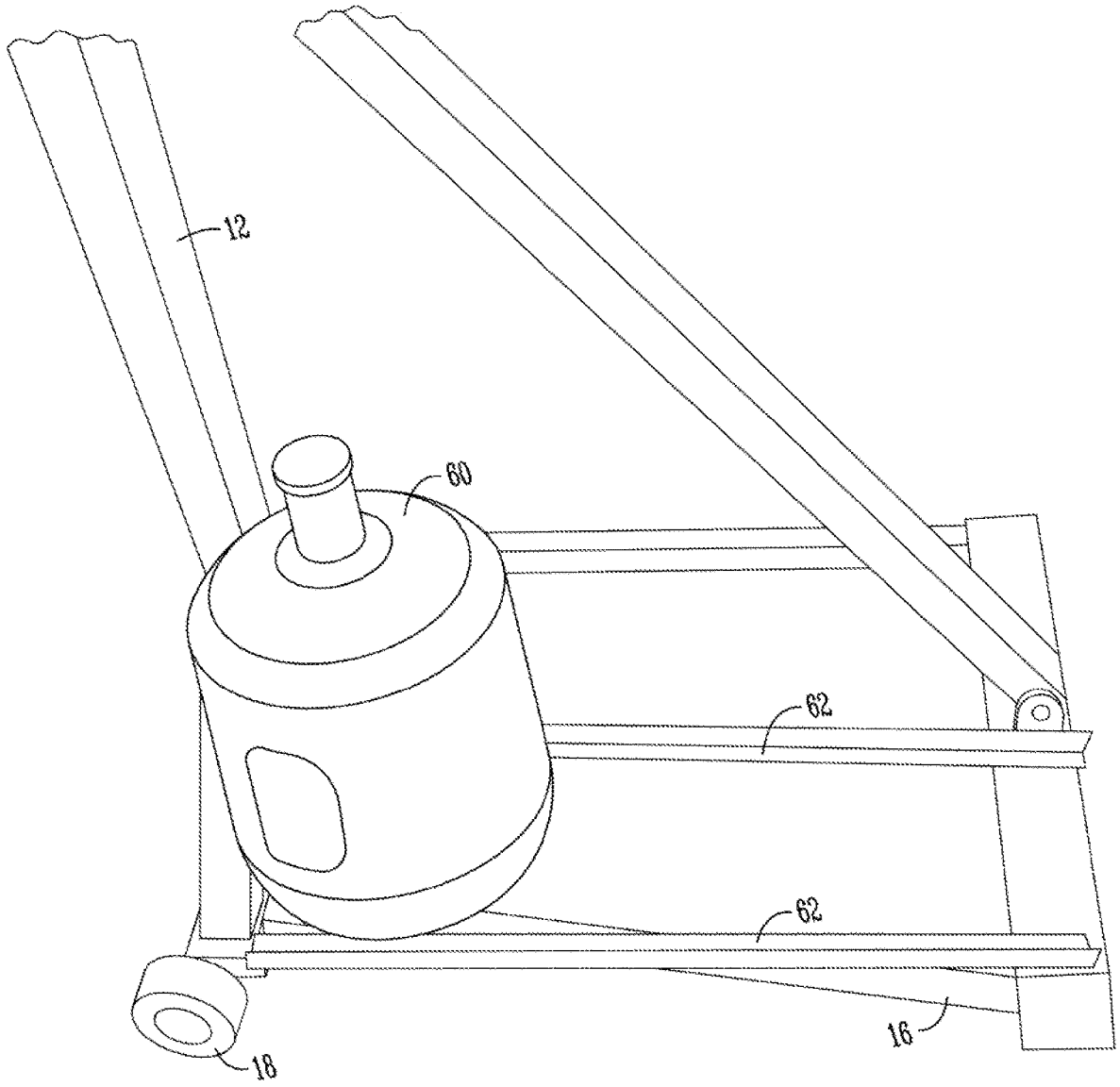
FIG. 7 shows the lower portion of FIG. 6 with the water jug moved near to the wheels of the device to make it easier to tilt and roll the device to a new location.

FIGS. 6 and 7 illustrate a preferred weighting system that can be used to retard unwanted movement or wandering of the device 10 that can result from repeated striking of the volleyball 30. In particular, weights 60 may be placed on the base 16 to increase the friction and inertia that impede sliding of the device 10 on the floor. Angle irons 62 provided on the base 16 of the riser structure 12 serve as support structures for supporting the weights 60. In a preferred embodiment the weights may be hollow containers that can be filled with a weighty substance. The hollow containers help reduce shipping weight. For example, the weights may be water jugs 60 that are shipped empty and then filled with water at the use site. Alternatively, the hollow containers 60 may be filled with sand or similar sold flowable material. The weights 60 may be slid on the angle irons 62 or other support structure between the position of FIG. 6 where the weight 60 is located a distance away from the wheels 18 to produce maximum friction with the floor and the position of FIG. 7, where the weight is near the wheels to make it easier to tilt the riser structure 12 for rolling movement of the device 10.

Thus, various configurations of a volleyball training device have been shown and described. It should be appreciated that the embodiments shown and described are for exemplary purposes, and the invention of a volleyball training device has thus been provided. It is to be contemplated that numerous variations, changes, and otherwise, which are obvious to those skilled in the art are to be considered part of the present invention.

What is claimed is:

1. A volleyball training apparatus comprising:

a rigid hollow arm, the hollow arm having a proximal end adapted for attachment to a riser and an open distal end spaced apart from the proximal end;

a resilient member having a first end and a second end, the resilient member extending at least partially through the hollow arm and operably connected to the arm at the first end of the resilient member;

an end cap covering the open distal end of the hollow arm, the end cap including a central opening;

a flexible connector having a first end attached to the second end of the resilient member and extending through the central opening in the end cap whereby a second end of the flexible connector is operably connected to a volleyball;

at least one spacer surrounding the flexible connector and located between the volleyball and the end cap; and a cup between the at least one spacer and the volleyball, the cup having an open end, whereby the volleyball is urged against the open end of the cup by the resilient member.

2. The volleyball training apparatus of claim 1, wherein the cup is surrounded by a padded layer.

3. The volleyball training apparatus of claim 1, wherein a tension level in the resilient member is adjustable.

4. The volleyball training apparatus of claim 3, further comprising a chain that operably connects the first end of the resilient member to the arm.

5. The volleyball training apparatus of claim 4, wherein:

the proximal end of the arm includes a slot sized and shaped such that links of the chain will pass through the slot in a first orientation but will not pass through the slot in a second orientation;

the chain extends through the slot; and whereby adjustment of the tension level is accomplished by pulling the chain through the slot until a desired tension is achieved and securing the chain by twisting a chain link adjacent to the slot to the second orientation.

6. The volleyball training apparatus of claim 1 further comprising a riser structure including an upright riser and a base; wherein the upright riser matingly receives the proximal end of the rigid hollow arm; and wherein the base is adapted to rest on a flat surface.

7. The volleyball training apparatus of claim 6, wherein the riser is adjustable to adjust a height of the arm above the base.

8. The volleyball training apparatus of claim 6, wherein the base includes a first end proximate to a connection between the upright riser and the base and a second end opposite from the first end of the base; the apparatus further comprising wheels proximate to the first end of the base for rolling transport of the apparatus on the flat surface.

9. The volleyball training apparatus of claim 8, wherein the base is adapted to support at least one weight in a first position proximate to the second end of the base to retard unwanted movement of the apparatus during use.

10. The volleyball training apparatus of claim 9, wherein the base is further adapted to support the at least one weight in second position proximate to the first end of the base to facilitate tilting of the apparatus at the wheels and rolling transport of the tilted apparatus on the wheels across the flat surface.

11. The volleyball training apparatus of claim 9, further comprising the at least one weight, and wherein the at least one weight comprises a hollow container adapted to be filled with a heavy substance.

12. The volleyball training apparatus of claim 11 wherein the heavy substance is water.

13. The volleyball training apparatus of claim 11 wherein the heavy substance is a flowable solid material.

14. A volleyball training apparatus comprising:

a rigid hollow arm, the hollow arm having a proximal end adapted for attachment to a riser and an open distal end spaced apart from the proximal end;

a resilient member having a first end and a second end, the resilient member extending at least partially through the hollow arm and operably connected to the arm at the first end of the resilient member, wherein a tension level in the resilient member is adjustable;

a chain that operably connects the first end of the resilient member to the arm;

an end cap covering the open distal end of the hollow arm, the end cap including a central opening;

a flexible connector having a first end attached to the second end of the resilient member and extending through the central opening in the end cap whereby a second end of the flexible connector is operably connected to a volleyball;

wherein the proximal end of the arm includes a slot sized and shaped such that links of the chain will pass through the slot in a first orientation but will not pass through the slot in a second orientation;

wherein the chain extends through the slot; and whereby adjustment of the tension level is accomplished by pulling the chain through the slot until a desired tension is achieved and securing the chain by twisting a chain link adjacent to the slot to the second orientation.

15. The volleyball training apparatus of claim 14 further comprising:

a riser structure including an upright riser and a base, wherein the upright riser matingly receives the proximal end of the rigid hollow arm; and wherein the base is adapted to rest on a flat surface, and wherein the base includes a first end proximate to a connection between the upright riser and the base and a second end opposite from the first end of the base; and wheels proximate to the first end of the base for rolling transport of the apparatus on the flat surface, and wherein the riser structure is adapted to support at least one weight in a first position proximate to the second end of the base to retard unwanted movement of the apparatus during use.

16. The volleyball training apparatus of claim 15, further adapted to support the at least one weight in second position proximate to the first end of the base to facilitate tilting of the apparatus at the wheels and rolling transport of the tilted apparatus on the wheels across the flat surface.

17. The volleyball training apparatus of claim 14, further comprising at least one spacer surrounding the flexible connector and located between the volleyball and the end cap.

18. The volleyball training apparatus of claim 14, further comprising at least three spacers surrounding the flexible connector and located between the volleyball and the end cap.

19. The volleyball training apparatus of claim 17 further comprising a cup between the at least one spacer and the volleyball, the cup having an open end, whereby the volleyball is urged against the open end of the cup by the resilient member.

20. The volleyball training apparatus of claim 19, wherein the cup is surrounded by a padded layer.

* * * * *